US005385494A

United States Patent [19]

Wilhelmi

[11] Patent Number: 5,385,494

[45] Date of Patent: Jan. 31, 1995

[54] FOOT BRACE AND LEVERAGED TURNING APPARATUS FOR SURFBOARDS

[76] Inventor: Gene Wilhelmi, 419 Main St., No. 74, Huntington Beach, Calif. 92648

[21] Appl. No.: 31,290

[22] Filed: Mar. 12, 1993

[51] Int. Cl.[6] ..... B63B 35/79

[52] U.S. Cl. ..... 441/74; 114/39.2

[58] Field of Search ..... 441/74; 114/39.2

[56] References Cited

U.S. PATENT DOCUMENTS 4,129,911 12/1978 McDonald et al. ..... 441/74

FOREIGN PATENT DOCUMENTS 2637306 2/1978 Germany ..... 441/74

2906591 8/1980 Germany ..... 441/74

3001201 7/1981 Germany ..... 441/74

*Primary Examiner*—Jesus D. Sotelo

*Attorney, Agent, or Firm*—Lewis Anten; Amedeo Ferraro

[57] ABSTRACT

A surfboard having a foot brace and leveraged turning apparatus defined by a substantially "V" shaped channel which is positioned longitudinally along the length of the surfboard starting adjacent the aft end of the surfboard and terminating forward of the midsection of the surfboard, the apparatus being defined by a pair of inclined wall members that extend downwardly and inwardly, providing the riding surface of the surfboard.

16 Claims, 2 Drawing Sheets

FOOT BRACE AND LEVERAGED TURNING APPARATUS FOR SURFBOARDS

BACKGROUND OF THE INVENTION

1. Field of the Invention

The present invention relates generally to surfboards and more particularly to a surfboard having a foot brace and leveraged turning apparatus defined by a substantially "V" shaped channel which is positioned longitudinally along the length of the surfboard starting adjacent the aft end of the board and terminating forward of the midsection of the surfboard.

2. Description of the Prior Art

As is well known in the art, various problems and difficulties are encountered in providing surfers with positive means for controlling the action, leverage and maneuverability of surfboards. Presently, this depends solely on the stance and agility of the surfer as warranted by the condition and changing characteristics of a wave that the surfer is riding. Also, the surfer must condition the riding surface of the board so that his or her feet have a substantial positive traction at all times along the entire length of the riding surface of the surfboard. This is accomplished by coating the upper surface of the board with a wax or like substance so that when the surface is wet it remains tacky which prevents the surfer's feet from slipping as leveraging and various manipulating forces are applied to the surface.

Many types and configurations of surfboards have been tried and suggested. However, none that are used in the art today relate to improving the surface of the surfboard as a controlling means. More specifically, the surfboard art at present has not been directed to modifying a surfboard to provide a new surface configuration that would give the surfer a foot bracing means to overcome the problems as mentioned above.

As examples of some of the known art one may refer to any of the following United States Patents.

There is disclosed in U.S. Pat. No. 3,160,897 to J. M. Kelly a hydroplane surfboard that provides a vertically and transversely extending shoulder in the bottom face dividing the face into two discrete vertically spaced surfaces.

In U.S. Pat. No. 3,276,050 to P. Edwards a surfboard is disclosed having an improved hull that includes a configuration that establishes a planing hull as contrasted with a displacement hull. The bottom of the hull is designed so that at certain stages of travel the board may be ridden closer to the nose. The surfboard is provided with a patch that is located forward of the midsection of the bottom of the board and defines a dished-out section, whereby the rider can convert from a displacement hull to a planing hull, planing being assisted by flow of water upwardly against the patch due to the tilt of the board, the slope of the wave, and the momentum thereof.

In the disclosure of U.S. Pat. No. 3,289,227 to J. M. Kelly, Jr., there is disclosed a surfboard with a nose and/or midsection lift generating means at the underside of the middle and nose portion which comprises concave or slotted areas or combinations thereof which trap the sidewise-displaced water, converting it into lift and thus making the much desired nose-riding capabilities of the surfboard applicable to other positions besides those on the wave crest where the rising motion of the water is pronounced.

In U.S. Pat. No. 4,129,911 there is disclosed a surfboard having a soft deck and a method of making same. The upper surface of the surfboard is formed with an elongated cavity in which is fixedly position a soft pliant deck. The soft pliant deck is then covered with an impervious sheet of flexible material such as a coating of vinyl. The coating is sealed over the body of the surfboard and the fiberglass coating on the rails.

OBJECTS AND ADVANTAGES OF THE INVENTION

The present invention is a surfboard having an improved riding surface or deck that is defined by foot bracing and a leveraged surface configuration which includes a pair of oppositely disposed and inclined surface wall members that generally form a "V" shaped longitudinal channel substantially along the length of the surfboard, starting adjacent the tail or stern of the board and terminating forward of the midsection thereof. Various preferred embodiments will be herein disclosed, wherein several methods of forming the riding surface may be employed to create the basic results and objects of the present invention.

Accordingly it is the primary object of the present invention to provide a surfboard with a riding surface that allows the surfer to establish a positive control and maneuverability of the surfboard under various wave conditions.

Another object of the invention is to provide a surfboard that is formed having foot bracing members that are defined by the oppositely positioned outwardly and upwardly inclined wall sections or members which allow the surfer to place his or her feet in positive engagement with the riding surface or deck of the surfboard.

Still another object of the present invention is to provide an improved deck configuration of a surfboard wherein the inclined walls cause the riding surface of the board to be tapered inwardly and downwardly so that the surfer's feet are slightly below the upper line of the deck surface.

A further object of the present invention is to provide a new riding surface configuration for surfboards wherein the surfer's feet have a braced/counter-braced footing that remains constant as the surfer's feet are repositioned on the surfboard fore and aft during the ride.

Still a further object of the invention is to provide a surfboard wherein the configuration of the riding surface improves leverage which allows a type of "power steering" which increases the rider's turning potential, thereby providing dramatic increases in speed and maneuverability.

A still further object of the present invention is to provide a surfboard of this character that can have its surface factory-formed and shaped or the inclined walls can be installed by the surfer by adding a pair of elongated inclined sheets to the existing riding surface of the board. These sheets can be selectively positioned and have varying widths, lengths and thicknesses to suit the individual preference of the surfer. Such an arrangement also provides a lower center of gravity which contributes to high-speed turns and overall stability not found in known surfboard construction.

The characteristics and advantages of the invention are further sufficiently referred to in connection with the accompanying drawings, which represent several embodiments. After considering these examples, skilled persons will understand that other variations may be made without departing from the principles disclosed; and I contemplate the employment of any structures, arrangements or modes of operation that are properly within the scope of the appended claims.

BRIEF DESCRIPTION OF THE DRAWINGS

Novel features and advantages of the present invention in addition to those mentioned above will become apparent to those skilled in the art from reading the following detailed description in conjunction with the accompanying drawings wherein.

DETAILED DESCRIPTION OF THE INVENTION

Figures 1, 2, 3, 4, 5, 6, 7:
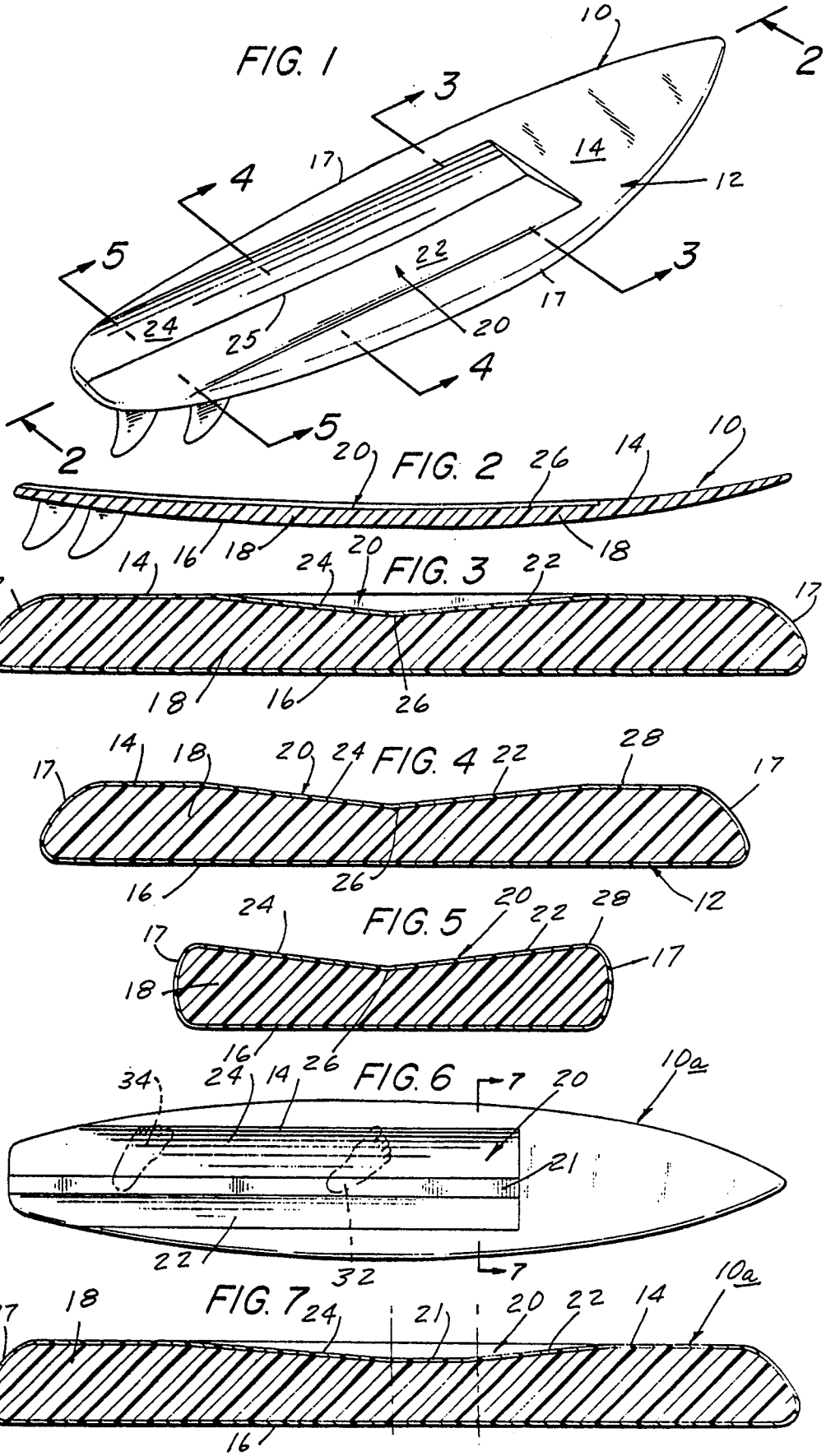
FIG. 1 is a perspective view of a surfboard having a leveraging and turning apparatus formed in the riding surface of the surfboard.
FIG. 2 is a longitudinal cross-sectional view taken substantially along line 2—2 of FIG. 1.
FIG. 3 is an enlarged transverse cross-sectional view taken forward of the midsection of the surfboard along line 3—3 of FIG. 1.
FIG. 4 is an enlarged transverse cross-sectional view taken rearwardly of the midsection of the surfboard along line 4—4 of FIG. 1.
FIG. 5 is an enlarged transverse cross-sectional view taken at the stern portion of the surfboard along line 5—5.
FIG. 6 is a top plan view of a second embodiment of the present invention wherein the substantially "V" shaped channel is shown truncated so as to define an intermediate flat wall.
FIG. 7 is an enlarged cross-sectional view taken substantially along line 7—7 of FIG. 6, showing the oppositely inclined wall members terminating at the intermediate flat wall of the riding surface thereof.

Referring more particularly to FIGS. 1 through 5, there is illustrated a surfboard, generally indicated at 10, formed having a typical elongated body member 12 that represents one of many known body styles now in use. Surfboards in general are defined by an elongated main body member 12 having a suitable length as preferred by the user thereof. Main body member 12 comprises an upper riding surface 14 and a lower surface 16 that is adapted to engage the surface of a body of water. The surfboard is constructed having usually hard or firm upper and lower surfaces and rail lines 17 which define the outer edges of the board formed on a body core 18 of suitable lightweight but strong floatation material such as a polyurethane plastic foam.

In the embodiment illustrated in FIGS. 1 through 5, the surfboard 10 is shaped from a blank body core 18 so as to provide the necessary configuration that includes the desired rails and proper thickness to accommodate for the forming of the substantially "V" shaped channel 20 longitudinally along the greater portion of the body core 18. The channel 20 defines both a foot bracing means and a leveraging means that starts from the stern of the body core and extends forward towards the nose body core, and terminates at a selected location between the midsection and then the nose of core 18, which is readily illustrated in FIG. 1.

The "V"-shaped channel 20 is defined by a pair of oppositely positioned inclined wall members which will be more specifically referred to as a right wall member 22 and a left wall member 24. Each wall member is inclined upwardly and outwardly and met substantially along the longitudinal center line 25 of the surfboard to define an inverted apex 26. However, it is contemplated that the inverted apex 26 of channel 20 can be readily positioned on one side or the other of center line 25 as desired by the surfer. That is, the overall width of the channel is determined by the overall width of the surfboard. When apex 26 is moved to the right of centerline 25, the width of the right inclined wall 22 is reduced and the width of the left inclined wall 24 is widened. The reverse is true when apex 26 is located to the left of centerline 25 in which case the right inclined wall will be wider than the left inclined wall 24. This allows the surfer to obtain and use a surfboard that is adapted to the surfer's size, ability and personal preference of style and stance while surfing.

A coating 28 of fiberglass and polystyrene resin is put over the formed body core in the normal manner well known in the art of manufacturing surfboards. When the surfboard is completed the inverted apex is approximately one-eighth to one-half inch below the outer upper edges 30 of the channel 20. The preferred width of each inclined wall member is between six inches to four and a half inches or the combination of the two widths, wherein the wall member would have a width of six inches and the opposite wall member would complement the opposite wall member of four and a half inches. However, various other dimensions may be employed when a surfboard is custom made.

Referring now to the embodiment as illustrated in FIGS. 6 and 7, there is shown a surfboard **10*a* that is formed generally as described above but with one change made to the apex of the "V" shaped channel 20. The apex is truncated, whereby an intermediate flat support wall 21 is provided having a width of between one to two inches, the preferable width being approximately one and a half inches. FIG. 6 shows a pair of surfer's feet in phantom lines, indicated by numerals 32 and 34, which are shown on riding surface 14 of channel 20. More specifically, the ball of the surfer's right foot 32 is placed on the left upwardly inclined wall member 24 with the heel of the right foot being supported on the flat support wall 21. Left foot 34 is located rearward of right foot 32 and is also positioned as that of the right foot so that the ball of left foot 34 is resting on left wall member 24 with heel of foot 34 being positioned on flat support wall member 21. It should be noted that in FIGS. 6 and 7 one of the variations as mentioned above is illustrated, wherein left wall member 24 is shown as having a larger width than that of the right wall member 22**. This allows the surfer to have a high degree of leveraged turning control and a positive means of bracing the feet for greater maneuverability of the surfboard as the rolling wave changes its configuration.

Figure 8:
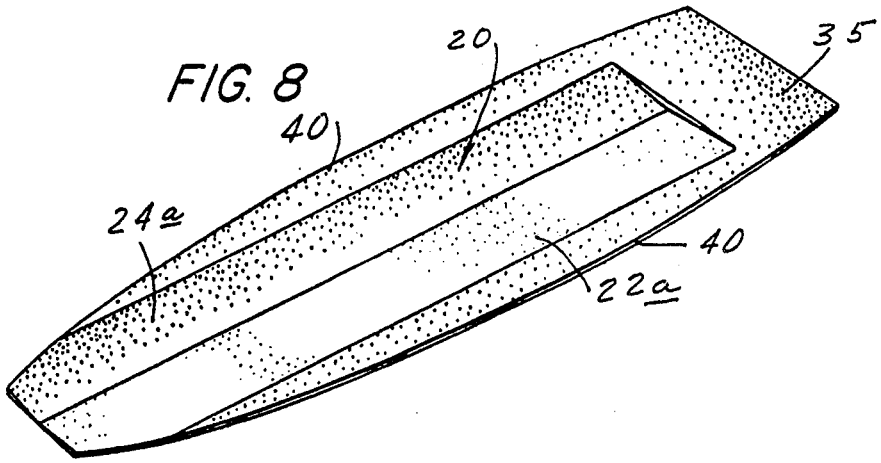
FIG. 8 is perspective view of another embodiment of the present invention which comprises a single-sheet, pre-formed riding surface structure having a pair of inclined wall members that define a foot bracing device for mounting to the upper surface of an existing surfboard.
Figure 9:
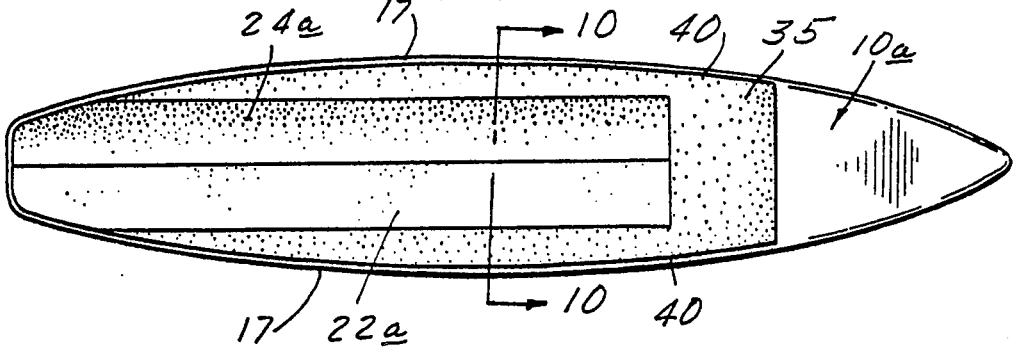
FIG. 9 is a top plan view of the above pre-formed riding surface mounted to an existing riding surface of a surfboard.
Figure 10:
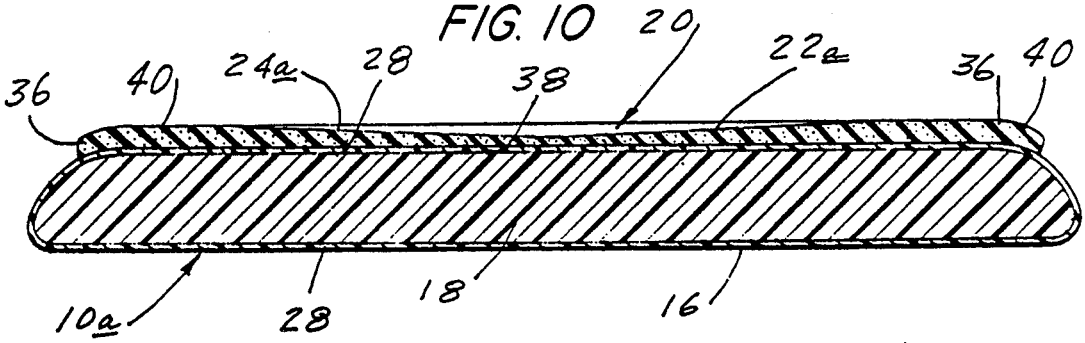
FIG. 10 is an enlarged cross-sectional view taken substantially along line 10—10.

Referring now to FIGS. 8, 9 an 10, there is illustrated another embodiment of the invention, wherein "V" shaped channel 20 is formed in an elongated sheet of foam plastic 35, more specifically a Styrofoam material pre-shaped in accordance with the personal preference of the surfer and provided with a flat bottom surface 38, as indicated in FIG. 10, whereby sheet 35 is readily mounted and secured to the riding surface of an existing surfboard 10*a*. The outer edges 40 of sheet 35 will conform to the outer rails 17 of the surfboard, as seen in FIG. 10, and can be shaped in various configurations having different lengths of between two to six feet so as to correspond to the length of the surfboard on which it is to be mounted. Each respective inclined wall member 22*a* and 24*a* is formed having an outer thick portion 36 of between one-eighth to one-half inch that tapers downwardly and inwardly so as to define a "V" shaped channel 20. This channel can be formed with either an apex 26 or a truncated apex which defines a flat support wall member 21, as described above.

Figure 11:
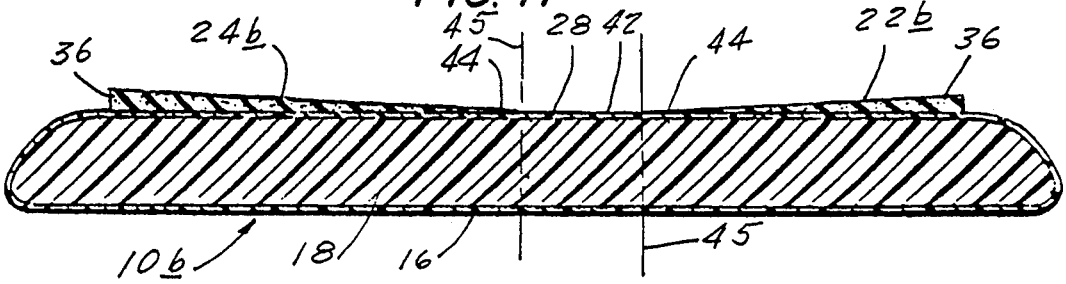
FIG. 11 is an enlarged cross-sectional view similar to FIG. 10, showing another embodiment wherein the oppositely disposed inclined walls are individual members that are spaced apart to define a central flat section along the surface of the surfboard.

Another embodiment of the invention is contemplated, illustrated in FIG. 11 of the drawings. This embodiment comprises a pair of individual elongated inclined wall members 22*b* and 24*b*. Wall member 22*b* is mounted on the right side of surfboard 10*b* and wall member 24*b* is mounted on the left side of the surfboard. In FIG. 11 left inclined wall member 22*b* is shown having a smaller width than that of right inclined wall member 24*b*. The feathered edges 44 of inclined wall members are also shown spaced apart, exposing a portion of the riding surface 42 of the surfboard so as to define a flat support wall, as indicated between vertical lines 45.

It may thus be seen that the objects of the present invention set forth herein, as well as those made apparent from the foregoing description, are efficiently attained. While the preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What I claim is:

1. A surfboard having a riding surface defined by a foot bracing and leveraged turning apparatus comprising:

a surfboard body having a core member comprising a stern portion, a nose portion, an upper surface, a bottom surface, and oppositely disposed side rails;

bracing and leveraged turning means defined by a concave depression formed in said upper surface, said concave depression having a lower surface and a pair of oppositely disposed inclined wall members positioned longitudinally along at least a portion of the length of said surfboard, each of said pair of wall members extending from said lower surface toward said side rails, said lower surface having a maximum height where said lower surface meets said pair of wall members whereby a riding surface is defined that is entirely recessed within said upper surface, said bracing and leveraged turning means being positioned between the stern and nose portion of said surfboard body, whereby the feet of a surfer are selectively positioned along said bracing and leveraged turning means so as to control the action and direction of the surfboard in a positive manner.

2. The surfboard of claim 1 in which at least one of said pair of wall members has a width capable of accommodating at least the ball portion of the foot of a surfer.

3. A surfboard having a riding surface defined by a foot bracing and leveraged turning apparatus comprising:

a surfboard body having a core member disposed within a shell covering comprising a stern portion, a nose portion, an upper surface, a bottom surface, and oppositely disposed side rails;

bracing and leveraged turning means defined by a concave depression formed in said upper surface, said concave depression being positioned longitudinally along the length of said surfboard, whereby a riding surface is defined that is entirely recessed within said upper surface, said bracing and leveraged turning means being positioned between the stern and nose portion of said surfboard body, whereby the feet of a surfer are selectively positioned along said bracing and leveraged turning means so as to control the action and direction of the surfboard in a positive manner wherein the bracing and leveraging means comprises a substantially "V"-shaped channel extending from the stern and terminating forward of the midsection of the surfboard body.

4. A surfboard as recited in claim 3, wherein said "V"-shaped channel is defined by a first inclined wall member and an oppositely disposed second inclined wall member, wherein each of said wall members extend upwardly and outwardly from the inverted apex of the channel.

5. A surfboard as recited in claim 4, wherein said inverted apex of said "V"-shaped channel is truncated, thereby defining an intermediate flat wall member positioned between the respective first and-second wall members.

6. A surfboard as recited in claim 5, wherein said first inclined wall member has a width equal to said second inclined wall member.

7. A surfboard as recited in claim 5, wherein said second inclined wall member has a width equal to said first inclined wall member.

8. The surfboard of claim 5 in which said first inclined wall member has a width that is less than the width of said second inclined wall member.

9. A surfboard having a riding surface defined by a foot bracing and leveraged turning apparatus comprising:

a surfboard body having a core member disposed within a shell covering comprising a stern portion, a nose portion, an upper surface, a bottom surface, and oppositely disposed side rails;

bracing and leveraged turning means formed in said upper surface, whereby a riding surface is defined, said bracing and leveraged turning means being positioned between the stern and nose portion of said surfboard body, whereby the feet of a surfer are selectively positioned along said bracing and leveraged turning means so as to control the action and direction of the surfboard in a positive manner, said bracing and leveraging means comprising a substantially "V"-shaped channel extending from the stern and terminating forward of the midsection of the surfboard body, said "V"-shaped channel being defined by a first inclined wall member and an oppositely disposed second inclined wall member, wherein each of said wall members extend upwardly and outwardly from the inverted apex of the channel,wherein said first inclined wall member has a width equal to or less than said second inclined wall member, wherein each said inclined wall member has a thick outer edge portion that tapers downwardly to define an inner feathered edge portion, wherein said outer edge portion has a thickness of between one-eighth and one-half inch, wherein each of said inclined wall members has a width of between four and a half inches to six inches, and said inverted apex of said "V"-shaped channel is truncated, thereby defining an intermediate flat wall member positioned between the respective first and second wall members.

10. A surfboard having a riding surface defined by a foot bracing and leveraged turning apparatus comprising:

a surfboard body having a core member disposed within a shell covering comprising a stern portion, a nose portion, an upper surface, a bottom surface, and oppositely disposed side rails;

bracing and leveraged turning means formed on said upper surface, whereby a riding surface is defined, said bracing and leveraged turning means being positioned between the stern and nose portion of said surfboard body, whereby the feet of a surfer are selectively positioned along said bracing and leveraged turning means so as to control the action and direction of the surfboard in a positive manner, said bracing and leveraging means comprising a substantially "V"-shaped channel extending from the stern and terminating forward of the midsection of the surfboard body, said "V"-shaped channel being defined by a first inclined wall member and an oppositely disposed second inclined wall member, wherein each of said wall members extend upwardly and outwardly from the inverted apex of the channel, wherein said "V"-shaped channel is formed in a sheet of foam plastic which is fixedly mounted to the upper surface of the surfboard.

11. A surfboard as recited in claim 10, wherein said apex of said "V"-shaped channel is truncated, thereby defining an intermediate flat wall member.

12. A surfboard as recited in claim 11, wherein said first inclined wall member is formed having a width equal to or less than said second inclined wall member.

13. A surfboard as recited in claim 11, wherein said second inclined wall member is formed having a width equal to or less than said first inclined wall member.

14. A surfboard as recited in claim 13, wherein each of said inclined wall members is formed having a thick outer edge portion that tapers downwardly to define an inner feathered edge portion, wherein said outer edge portion is formed having a thickness of between one-eighth and one-half inch, and wherein the width of each of said inclined wall members is between four and a half inches to six inches.

15. A surfboard having a riding surface defined by a foot bracing and leveraged turning apparatus comprising:

a surfboard body having a core member disposed within a shell covering comprising a stern portion, a nose portion, an upper surface, a bottom surface, and oppositely disposed side rails;

bracing and leveraged turning means formed on said upper surface, whereby a riding surface is defined, said bracing and leveraged turning means being positioned between the stern and nose portion of said surfboard body, whereby the feet of a surfer are selectively positioned along said bracing and leveraged turning means so as to control the action and direction of the surfboard in a positive manner, said bracing and leveraging means comprising a substantially "V"-shaped channel extending from the stern and terminating forward of the midsection of the surfboard body, said "V"-shaped channel being defined by a first inclined wall member and an oppositely disposed second inclined wall member, wherein each of said wall members extend upwardly and outwardly from the inverted apex of the channel, wherein said "V"-shaped channel is formed by a pair of individual sheets of foam plastic which define inwardly and downwardly tapered wall members that are fixedly mounted to the upper surface of the surfboard.

16. A surfboard as recited in claim 15, wherein said pair of individual sheets are fixedly mounted to the upper surface of the surfboard in a spaced relation to each other, thereby defining an intermediate flat wall positioned therebetween.

* * * * *